US009899752B2

(12) United States Patent
Wu et al.

(10) Patent No.: US 9,899,752 B2
(45) Date of Patent: Feb. 20, 2018

(54) WIRE CONNECTION TERMINAL STRUCTURE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Wei-Chi Chen, New Taipei (TW); Jheng-Wei Chen, New Taipei (TW)

(73) Assignees: Switch Inc., New Taipei (TW); Switch (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/414,947

(22) Filed: Jan. 25, 2017

(65) Prior Publication Data

US 2017/0229792 A1 Aug. 10, 2017

(30) Foreign Application Priority Data

Feb. 5, 2016 (TW) ..... 105104207 A

(51) Int. Cl.

| | |
|---|---|
| ***H01R 4/48*** | (2006.01) |
| ***H01R 12/51*** | (2011.01) |
| ***H01R 4/58*** | (2006.01) |
| ***H01R 9/24*** | (2006.01) |

(52) U.S. Cl.

CPC ..... *H01R 4/4818* (2013.01); *H01R 4/58* (2013.01); *H01R 9/2408* (2013.01); *H01R 12/515* (2013.01)

(58) Field of Classification Search

CPC .. H01R 4/4827; H01R 4/4836; H01R 4/4818; H01R 4/4845

USPC ..... 439/435–441

See application file for complete search history.

(56) References Cited

U.S. PATENT DOCUMENTS

| | | | | |
|---|---|---|---|---|
| 6,796,855 | B2 * | 9/2004 | Fricke | H01R 4/4818 439/835 |
| 9,525,218 | B2 * | 12/2016 | Wu | H01R 4/4818 |
| 9,525,219 | B2 * | 12/2016 | Kollmann | H01R 4/4836 |

* cited by examiner

*Primary Examiner* — Ross Gushi

(74) *Attorney, Agent, or Firm* — Rosenberg, Klein & Lee

(57) ABSTRACT

A wire connection terminal structure includes a leaf spring, a conductive plate and a fixing frame framing and connecting with the leaf spring and the conductive plate. The conductive plate is formed with a base section assembled with the fixing frame. The leaf spring is formed with an elastic swingable holding section extending to a position in contact with the base section. The holding section and the base section define therebetween an elastic holding mouth. An external electrical wire can be plugged into the holding mouth and held between the holding section and the base section and electrically connected with the conductive plate. The conductive plate and the fixing frame are two separate components so that the conductive plate is solely made of a high-conductivity material, while the fixing frame is made of a material with higher structural rigidity.

28 Claims, 8 Drawing Sheets

WIRE CONNECTION TERMINAL STRUCTURE

BACKGROUND OF THE INVENTION

1. Field of the Invention

The present invention relates generally to a wire connection terminal structure, and more particularly to an improved wire connection terminal structure for an external electrical wire to plug in and electrically connect therewith. The structure of the conductive plate of the wire connection terminal is simplified and the assembling strength of the entire wire connection terminal is enhanced. Therefore, the manufacturing cost of the wire connection terminal is lowered.

2. Description of the Related Art

A wire connection terminal is also referred to as an electrical connector. The wire connection terminal is mainly used to electrically connect the electrical wires between electronic components, electrical apparatuses, electronic equipments and circuit boards. In practice, the electronic components generally include resistors, capacitors, inductors, LED, transformers, liquid crystal panels, touch panels, etc. The electrical wires can be easily plugged into the electrical connector or unplugged out of the electrical connector. Therefore, the wire connection terminal serves to transmit power or electronic signals to facilitate layout and service of the internal circuit boards and electronic components of the electronic products and apparatuses.

Currently, there are various wire connection terminals on the market. As shown in FIGS. 1 and 2, a conventional wire connection terminal is mainly composed of a leaf spring 6 and a conductive frame 7. The leaf spring 6 and the conductive frame 7 are generally mounted in a plastic-made insulation outer case (not shown). The conductive frame 7 has a conductive base section 71 and a soldering leg 72 extending from the base section 71 out of the insulation outer case. The soldering leg 72 can be soldered on an external circuit board or electronic component. The base section 71 is further formed with a cantilever 73 extending from the base section 71 in a direction reverse to the extending direction of the soldering leg 72. The leaf spring 6 has a frame section 62 securable between the cantilever 73 and the base section 71 and a holding section 61 extending from one end of the frame section 62 toward an opposite end to elastically press and contact the base section 71. A holding mouth 60 is defined between the holding section 61 and the base section 71 and accessible from outer side of the insulation outer case. In use, an external electrical wire can be inserted between the holding section 61 and the base section 71 through the holding mouth 60. The holding section 61 serves to elastically push the electrical wire against the surface of the base section 71 and securely hold the electrical wire, whereby the electrical wire is electrically connected with the conductive frame 7. In order to make the wire connection terminal has better electrical conductivity and able to more securely hold the external electrical wire, the base section 71, the cantilever 73 and the soldering leg 72 of the conductive frame 7 are generally made of conductive metal material with high electrical conductivity and relative soft material property, (such as copper). Moreover, the leaf spring 6 is generally made of elastic steel material with high elasticity. Therefore, when choosing the material of the conductive frame 7, it is hard to achieve an optimal balance between excellent electrical conductivity and constant structural strength of the conductive frame 7 so that the leaf spring 6 can apply sufficient elastic pressing force to the electrical wire, while permitting the electrical wire to be plugged or unplugged. As a result, the structure of the conductive frame 7 is complicated. This is not an optimal design form.

When an electrical wire is plugged and held between the holding section 61 of the leaf spring 6 and the base section 71, the electrical wire will apply a reaction force to the holding section 61 to push back and compress/deform the holding section 61. Moreover, the elastic pressing force of the leaf spring 6 will be partially transmitted through the frame section 62 between the base section 71 and the cantilever 73 of the conductive frame 7. The conductive frame 7 is made of soft material so that the elastic pressing force due to the electrical wire held by the leaf spring 6 will directly cause bending or deformation of the parts of the cantilever 73 and the base section 71 that are near to the soldering leg 72. This will affect the ability of the holding mouth 60 to hold the external electrical wire and the smoothness of plugging/unplugging of the electrical wire. Furthermore, the conductive frame 7 is made of a one-piece metal material. The one-piece metal material is processed, such as punched or linearly cut, to form the structures of the base section 71, the cantilever 73 and the soldering leg 72. There are many invalided parts in addition to the base section 71, the cantilever 73 and the soldering leg 72. Also, the area of the entirely stretched raw material is quite large. As a result, a great amount of wasted material is produced in the manufacturing process. Moreover, to form the void section at the center of the frame section 62 of the leaf spring 6, a great area of wasted material is produced. Therefore, much material cost is wasted.

It is therefore tried by the applicant to provide an improved wire connection terminal structure to eliminate the above shortcomings existing in the conventional wire connection terminal.

SUMMARY OF THE INVENTION

It is therefore a primary object of the present invention to provide an improved wire connection terminal structure. The wire connection terminal structure includes a leaf spring, a conductive plate and a fixing frame, which are mounted in an insulation case and assembled with each other to form a wire connection terminal. The support strength of the entire wire connection terminal structure is enhanced so that the wire connection terminal structure is prevented from deforming due to external force. Moreover, the structures of the respective components of the wire connection terminal are simplified to lower the manufacturing cost. The present invention overcomes the shortcoming of the conventional wire connection terminal that the conductive frame has insufficient support strength so that the cantilever and the base section are easy to deform to reduce the utility. The present invention also overcomes the shortcoming of the conventional wire connection terminal that in the manufacturing process of the conductive frame and the leaf spring, a great amount of wasted material is produced so that the material cost is wasted. The present invention further overcomes the shortcoming of the conventional wire connection terminal that the conductive frame and the leaf spring have complicated structures and are uneasy to process.

To achieve the above and other objects, the wire connection terminal structure of the present invention includes a leaf spring, a conductive plate and a fixing frame, which are mounted in an insulation case. The leaf spring and the conductive plate are framed and assembled with the fixing frame. The conductive plate is formed with a base section assembled with the fixing frame and at least one soldering leg extending from the base section out of the case. The leaf spring is formed with an elastic swingable holding section extending to a position in contact with the base section. The leaf spring is further formed with a locating section secured to the fixing frame and a bight section connected between the locating section and the holding section. The holding section and the base section define therebetween an elastic holding mouth.

According to the above structure, the conductive plate can be made of a relatively soft metal material (such as copper), which has good electrical conductivity. The leaf spring is made of elastic steel with high elasticity, while the fixing frame is made of a material with high strength, such as stainless steel or iron material. In this case, the entire structure of the wire connection terminal has sufficient structural strength and is uneasy to deform. Moreover, the structures of the respective components are simplified and the amount of the wasted material produced in the manufacturing process is reduced so that the material cost is lowered and the entire structure is designed with higher utility.

In the above wire connection terminal structure, the fixing frame has a first fixing section, a second fixing section and a connection section in the form of a frame. The second fixing section is positioned in a position opposite to the first fixing section. The connection section is connected between the first and second fixing sections. The leaf spring and the conductive plate are respectively disposed and located on the first and second fixing sections. The elastic swingable holding section extends from the leaf spring to the base section of the conductive plate for pushing the base section and fixing the base section on the second fixing section. Accordingly, the leaf spring and the conductive plate abut against each other and are securely engaged in the fixing frame with high strength. It is easy to assemble and locate these components.

In the above wire connection terminal structure, the first fixing section is formed with a first stop section in a position opposite to the connection section. The first stop section extends from one edge of the first fixing section toward the second fixing section, which edge is distal from the connection section. The second fixing section is formed with a second stop section in a position opposite to the connection section. The second stop section extends from one edge of the second fixing section to the first fixing section, which edge is distal from the connection section. Accordingly, the first and second stop sections cooperate with the connection section to provide a framing and restricting effect for the leaf spring and the base section of the conductive plate. In this case, the respective components are more securely assembled with each other and uneasy to detach from each other.

In the above wire connection terminal structure, the leaf spring is formed with two wing sections and an upper edge of the first fixing section is formed with a shoulder section. The wing sections can be securely engaged with the shoulder section and located. Moreover, the locating section of the leaf spring is engaged with a boss of the first fixing section. By means of the shoulder section and the boss of the first fixing section, the leaf spring is two-way inlaid and restricted within the fixing frame.

In the above wire connection terminal structure, the width of the bight section between two sides thereof is larger than the width of the holding section and/or the locating section between two sides thereof and is smaller than or equal to the width between the outer surface of the first stop section and/or the second stop section and the outer surface of the connection section. Accordingly, the elastic force applied by the bight section to the holding section and the locating section can be enhanced. In this case, the leaf spring can be more securely and stably elastically tightened and located between the first fixing section and the base section.

In the above wire connection terminal structure, the connection section is formed with a third stop section. The third stop section extends from one edge of the connection section between the first and second fixing sections in a position opposite to the holding mouth. The third stop section serves to restrict the plug-in extent of the electrical wire and prevent the electrical wire from being overplugged. Also, the third stop section helps in securely locating the electrical wire in the insulation case.

In the above wire connection terminal structure, the soldering leg of the base section extends from at least one end of the base section.

The present invention can be best understood through the following description and accompanying drawings, wherein:

DETAILED DESCRIPTION OF THE PREFERRED EMBODIMENTS

Figure 1:
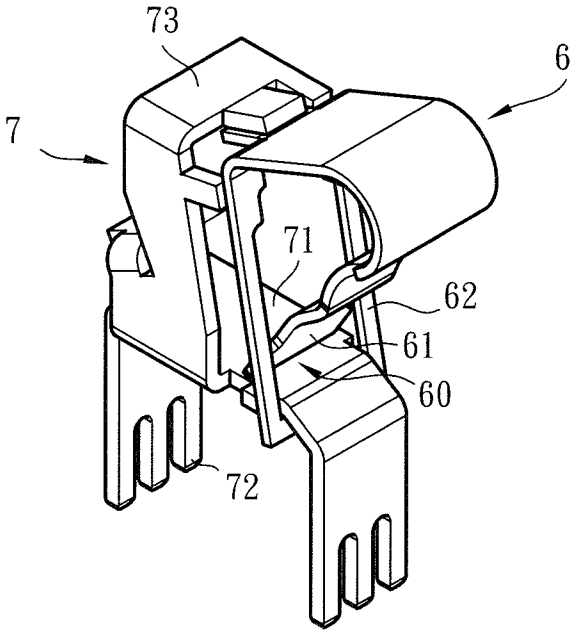
Fig. 1 PRIOR ART
FIG. 1 is a perspective assembled view of a conventional wire connection terminal, showing the leaf spring and the conductive frame thereof.
Figure 2:
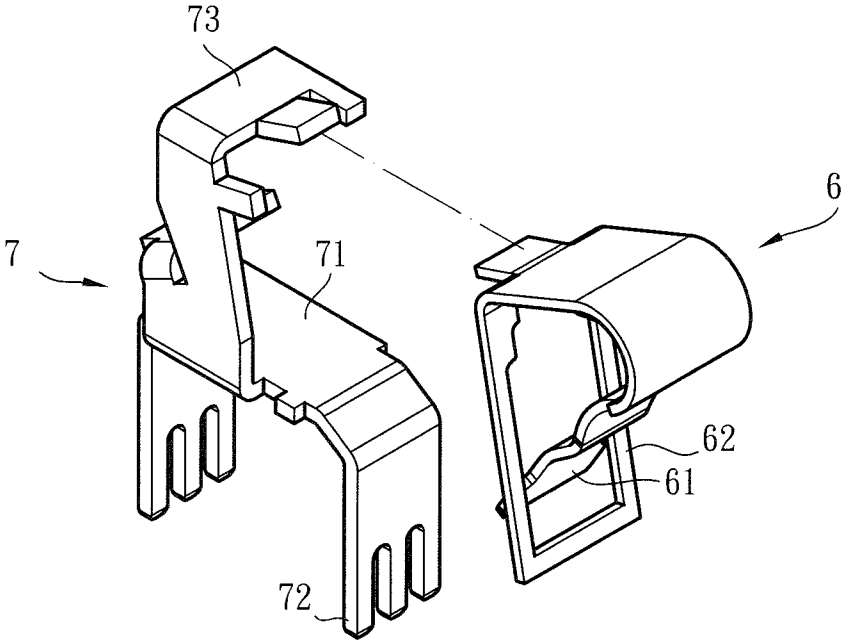
Fig. 2 PRIOR ART
FIG. 2 is a perspective exploded view of the conventional wire connection terminal according to FIG. 1.
Figure 3:
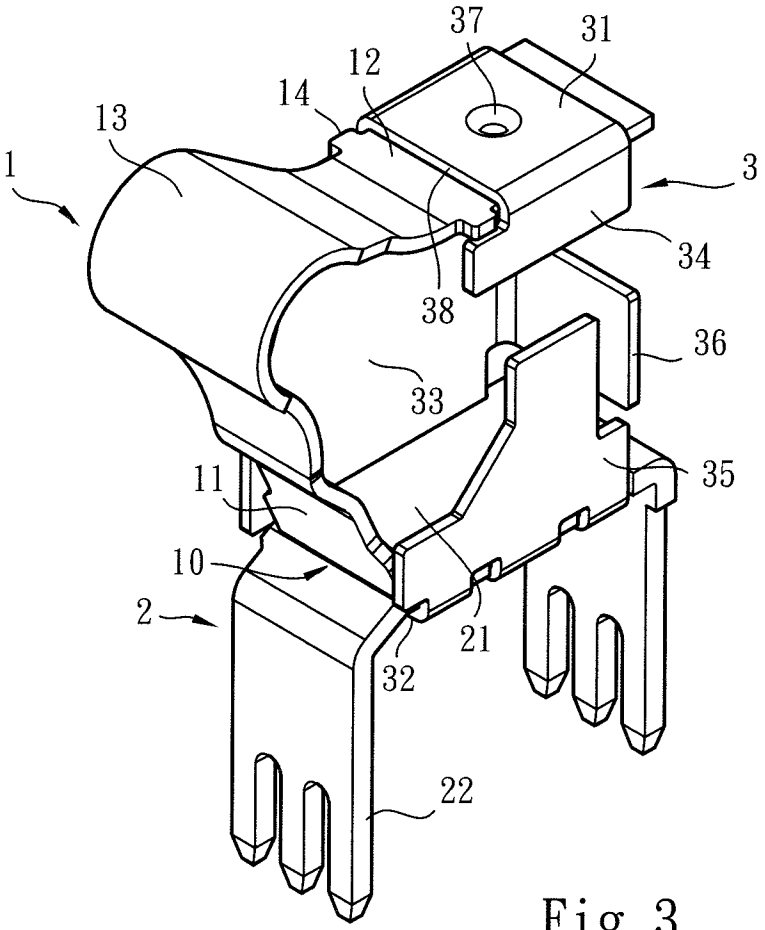
FIG. 3 is a perspective assembled view of the wire connection terminal structure of the present invention, showing the leaf spring, the conductive plate and the fixing frame thereof.
Figure 4:
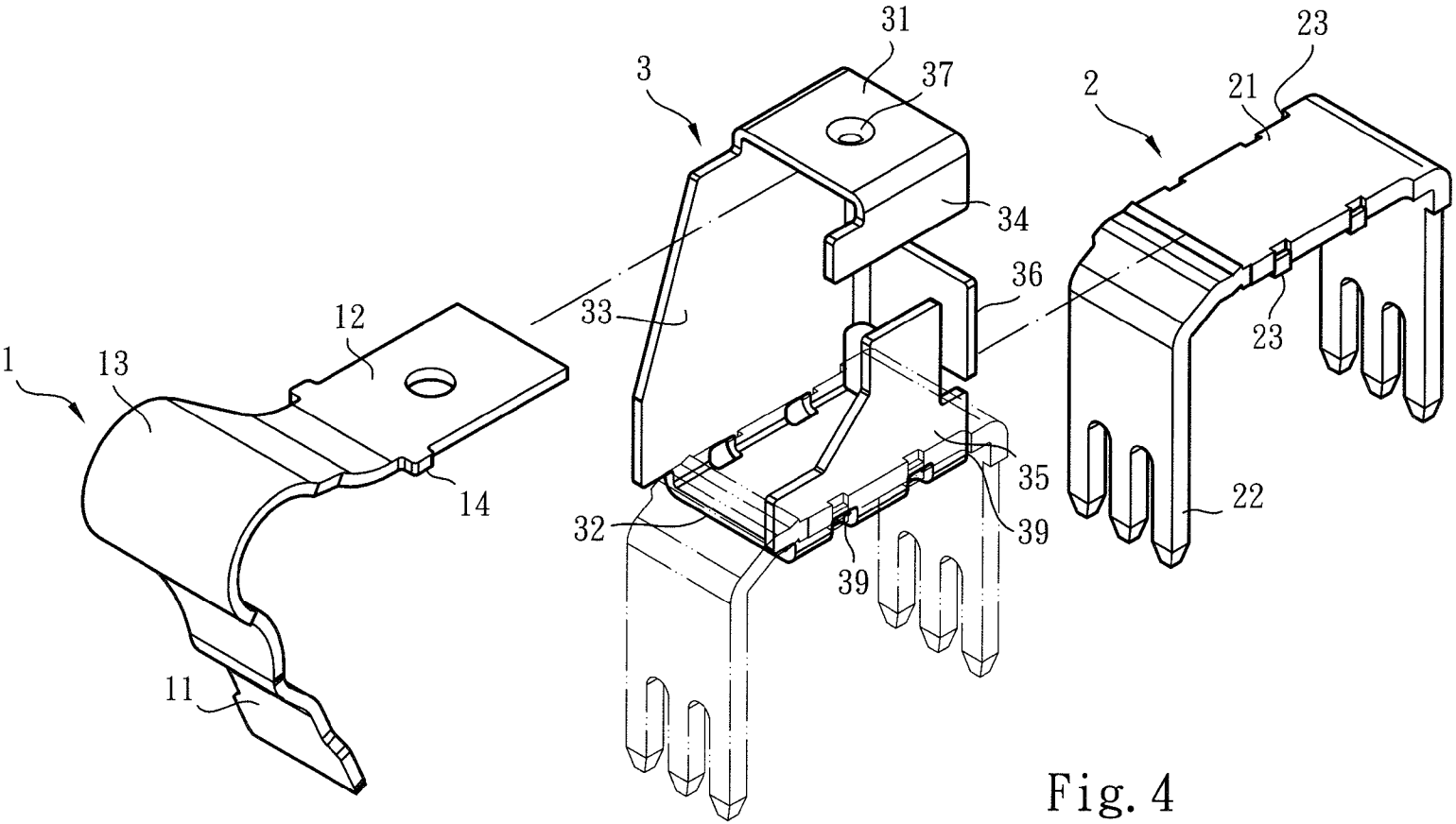
FIG. 4 is a perspective exploded view according to FIG. 3.
Figure 5:
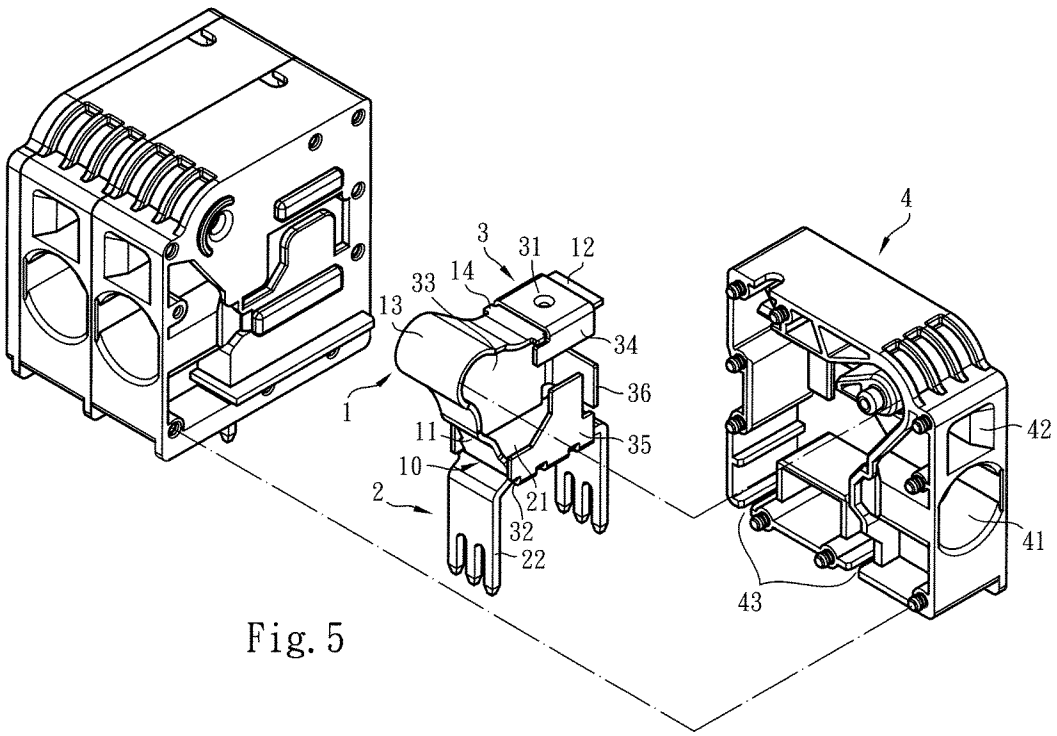
FIG. 5 is a perspective exploded view of the wire connection terminal of the present invention.

Please refer to FIGS. 3 and 5. According to a preferred embodiment, the wire connection terminal structure of the present invention includes a leaf spring 1, a conductive plate 2 and a fixing frame 3, which are mounted in an insulation case 4. The leaf spring 1 and the conductive plate 2 are framed and connected with the fixing frame 3. The conductive plate 2 is formed with abase section 21 assembled on the fixing frame 3 and at least one soldering leg 22 extending from the base section 21 out of the case 4. The leaf spring 1 is formed with an elastic swingable holding section 11 extending to a position in contact with the base section 21. The holding section 11 and the base section 21 define therebetween an elastic holding mouth 10. Preferably, the conductive plate 2 is made of a high-conductivity material (such as copper), which has an electrical conductivity better than the leaf spring 1 and the fixing frame 3. The leaf spring 1 is made of a material (such as elastic steel) with good elasticity, while the fixing frame 3 is made of a material (such as stainless steel or iron material) with higher structural rigidity.

As shown in the drawings, the leaf spring 1 is formed with a locating section 12 and a bight section 13. The bight section 13 is connected between the locating section 12 and the holding section 11, enabling the holding section 11 to elastically swing, bend and deform. In addition, two engagement wing sections 14 are formed near two sides of the locating section 12. The base section 21 has two ends. At least one of the two ends is formed with the soldering leg 22. In this embodiment, the fixing frame 3 has a first fixing section 31, a second fixing section 32 and a connection section 33 in the form of a frame. The first and second fixing sections 31, 32 are respectively disposed on two opposite positions. The connection section 33 is connected between the first and second fixing sections 31, 32. In addition, a first stop section 34 extends from one edge of the first fixing section 31 toward the second fixing section 32, which edge is distal from the connection section 33. A second stop section 35 extends from one edge of the second fixing section 32 in a direction reverse to the extending direction of the first stop section 34, which edge is distal from the connection section 33. The connection section 33 has a third stop section 36. The third stop section 36 extends from one edge of the connection section 33 in a position opposite to the holding mouth 10.

The leaf spring 1 and the conductive plate 2 are positioned between the first and second fixing sections 31, 32 of the fixing frame 3. The locating section 12 of the leaf spring 1 is located on the first fixing section 31 (engaged with a boss section 37 thereof) with the swingable holding section 11 extending toward the second fixing section 32. In addition, an upper edge of the first fixing section 31 is formed with a shoulder section 38 for engaging with the wing sections 14 of the leaf spring 1. The wing sections 14 can be engaged with the shoulder section 38 and located. The base section 21 of the conductive plate 2 is secured to the second fixing section 32 in a position opposite to the first fixing section 31. The soldering leg 22 at the end of the base section 21 extends out of the fixing frame 3. The conductive plate 2 and the fixing frame 3 are further formed with certain engagement structures 23, 39 to help in locating both. The case 4 is formed with a wire plug-in opening 41 in communication with the holding mouth 10, an operation opening 42 leading to the holding section 11 and at least one perforation 43 for the soldering leg 22 to extend through out of the case 4.

According to the above arrangement, the first fixing section 31 of the fixing frame 3 is located with the locating section 12 of the leaf spring 1. In addition, the locating section 12 of the leaf spring 1 is engaged with the boss section 37 of the first fixing section 31 and the wing sections 14 are engaged with the shoulder section 38 so as to enhance the locating effect. After assembled, the swingable holding section 11 of the leaf spring 1 elastically presses against the base section 21, whereby the leaf spring 1 is restricted between the first fixing section 31 and the base section 21 (equivalently the second fixing section 32). The leaf spring 1 applies a force to the base section 21 of the conductive plate 2 to bond with the second fixing section 32. The engagement structures 23, 39 between the base section 21 and the second fixing section 32 serve to enhance the locating effect for the base section 21 and the second fixing section 32. Accordingly, the fixing frame 3 can be securely assembled with the conductive plate 2 and the leaf spring 1 without riveting. Moreover, by means of the strong structural property of the fixing frame 3, the leaf spring 1 and the conductive plate 2 are well supported to respectively fully work at high performance.

In a preferred embodiment, the width of the bight section 13 between two sides thereof is larger than the width of the holding section 11 and/or the locating section 12 between two sides thereof. In addition, when the width of the bight section 13 is larger than the width between the outer surface of the first stop section 34 and/or the second stop section 35 and the outer surface of the connection section 33, the internal receiving space of the insulation case 4 is properly enlarged in a position where the bight section 13 is positioned. This can avoid interference with the operation. Therefore, the elastic force applied by the bight section 13 to the holding section 11 and the locating section 12 can be enhanced. In this case, the elastic force of the holding section 11, which elastically presses against or pushes the base section 21 and the elastic force of the locating section 12, which elastically presses against or pushes the first fixing section 31 can be effectively enhanced. Accordingly, the leaf spring 1 can be more securely and stably elastically tightened and located between the first fixing section 31 and the base section 21. Furthermore, the width of the bight section 13 between two sides thereof is not larger than the width between the outer surface of the first stop section 34 and/or the second stop section 35 and the outer surface of the connection section 33, so that a gap exists between the inner wall of the case 4 and the bight section 13 for the bight section 13 to freely bend and move.

Figure 6:
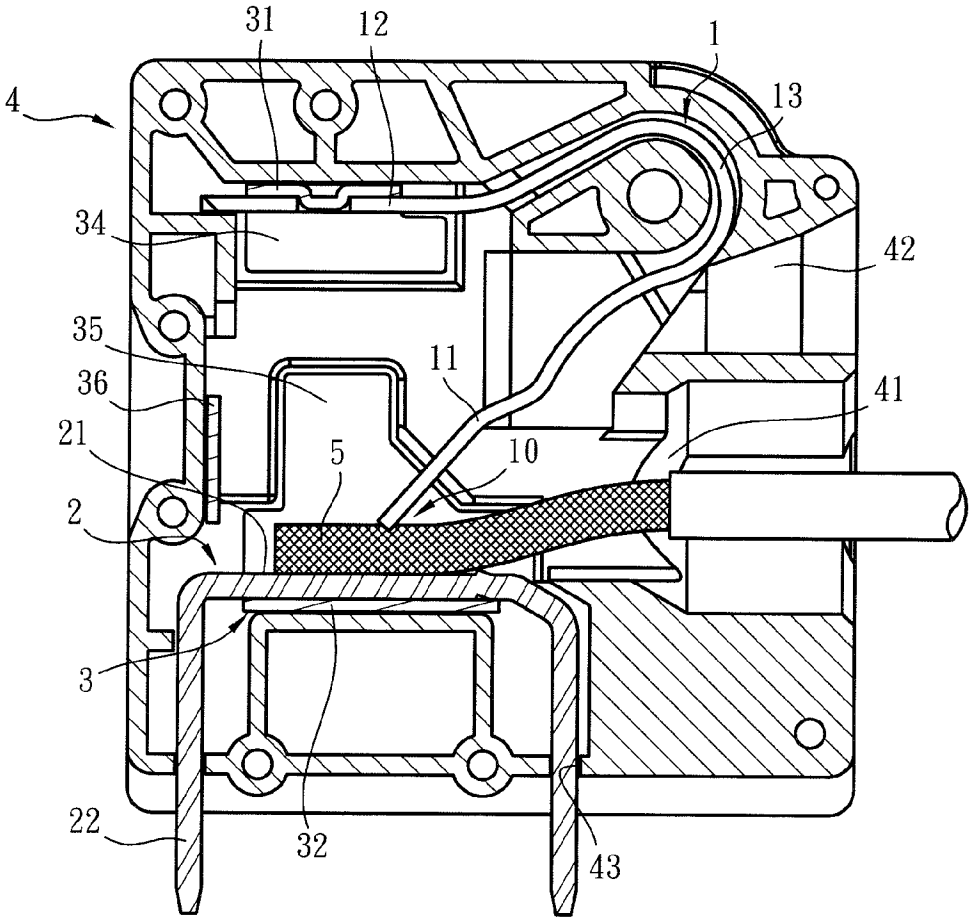
FIG. 6 is a sectional view of the wire connection terminal of the present invention.

As shown in FIG. 6, an external electrical wire 5 can be plugged through the wire plug-in opening 41 of the case 4 into the holding mouth 10 between the holding section 11 and the base section 21. The holding section 11 serves to elastically press the electrical wire 5 against the base section 21 and securely hold the electrical wire 5. The soldering leg 22 of the conductive plate 2 is electrically connected to the electrical wire 5 via the base section 21.

It should be noted that the internal metal assembly of the wire connection terminal structure of the present invention is composed of three metal components, that is, the leaf spring 1, the conductive plate 2 and the fixing frame 3. The conductive plate 2 is made of a material with high electrical conductivity. The leaf spring 1 and the fixing frame 3 are respectively made of elastic steel with high elasticity and stainless steel or iron material with high strength. Therefore, the physical properties of the respective components more meet the functional requirements. Under such circumstance, the leaf spring 1, the conductive plate 2 and the fixing frame 3 are all designed with more simplified structures so as to reduce the amount of wasted material and facilitate the manufacturing process as well as lower the material cost. Also, the support strength provided by the fixing frame 3 for the leaf spring 1 and the conductive plate 2 is enhanced. This can prevent the fixing frame 3 from deforming under the affection of the elastic force of the leaf spring 1.

Figure 7:
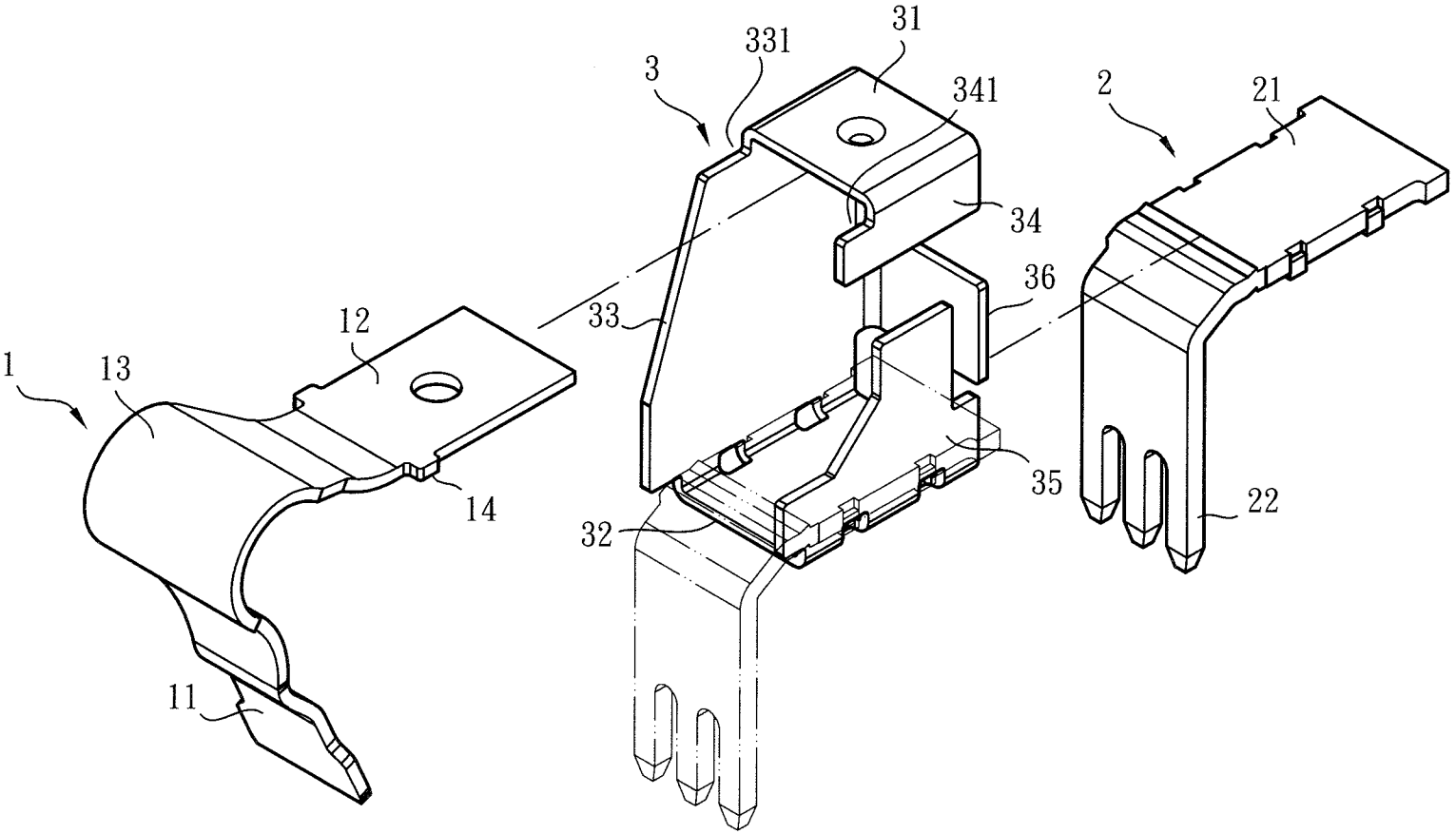
FIG. 7 is a perspective exploded view of another embodiment of the wire connection terminal structure of the present invention according to FIG. 4.
Figure 8:
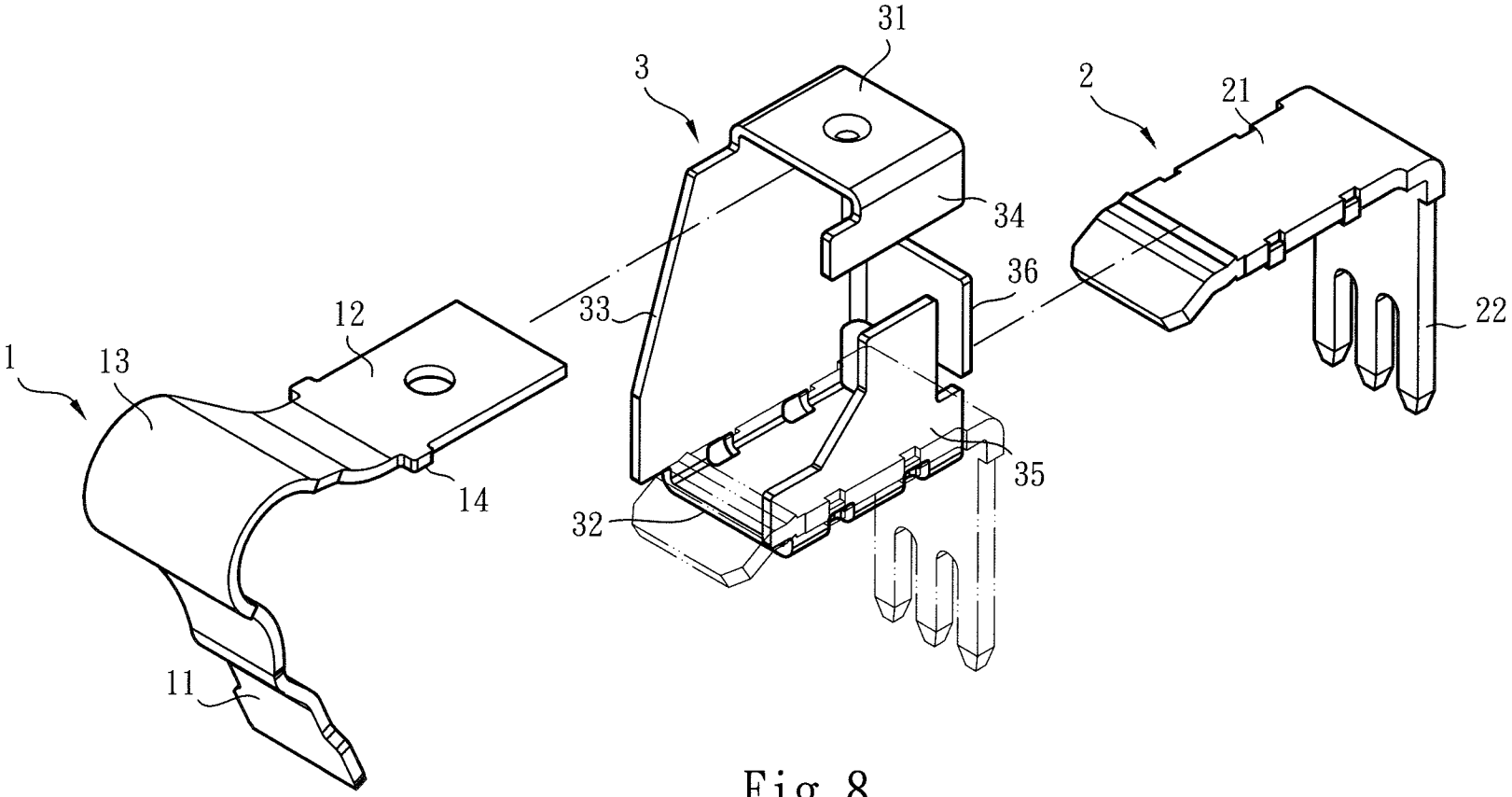
FIG. 8 is a perspective exploded view of still another embodiment of the wire connection terminal structure of the present invention according to FIG. 4.

Please now refer to FIGS. 7 and 8. In a modified embodiment, the soldering leg 22 is solely disposed at one end of the base section 21.

According to the above arrangements, the support strength of the entire structure of the present invention is enhanced so that the present invention is prevented from deforming due to external force. Moreover, the structures of the respective components are simplified and it is easy to assemble the components. Also, the manufacturing cost is lowered. The present invention overcomes the shortcoming of the conventional wire connection terminal that the conductive frame has insufficient support strength so that the cantilever and the base section are easy to deform to reduce the utility. The present invention also overcomes the shortcoming of the conventional wire connection terminal that in the manufacturing process of the conductive frame and the leaf spring, a great amount of wasted material is produced so that the material cost is wasted. The present invention further overcomes the shortcoming of the conventional wire connection terminal that the conductive frame and the leaf spring have complicated structures and are uneasy to process.

The above embodiments are only used to illustrate the present invention, not intended to limit the scope thereof. Many modifications of the above embodiments can be made without departing from the spirit of the present invention.

What is claimed is:

1. A wire connection terminal structure comprising a leaf spring, a conductive plate and a fixing frame, which are mounted in an insulation case, the fixing frame having a first fixing section, a second fixing section and a connection section in the form of a frame, the second fixing section being positioned in a position opposite to the first fixing section, the connection section being connected between the first and second fixing sections, the leaf spring and the conductive plate being framed and assembled with the fixing frame, the leaf spring and the conductive plate being respectively disposed and located on the first and second fixing sections, the conductive plate being formed with a base section assembled with the fixing frame and at least one soldering leg extending from the base section out of the case, the leaf spring being formed with an elastic swingable holding section extending to a position in contact with the base section, the elastic swingable holding section extending from the leaf spring to the base section of the conductive plate for pushing the base section and fixing the base section on the second fixing section, the leaf spring being further formed with a locating section secured to the fixing frame and a bight section connected between the locating section and the holding section, the holding section and the base section defining therebetween an elastic holding mouth, and the leaf spring being formed with wing sections and an upper edge of the first fixing section being formed with a shoulder section, whereby the wing sections can be securely engaged with the shoulder section.

2. The wire connection terminal structure as claimed in claim 1, wherein the first fixing section is formed with a first stop section in a position opposite to the connection section, the first stop section extending from one edge of the first fixing section toward the second fixing section, which edge is distal from the connection section, the second fixing section being formed with a second stop section in a position opposite to the connection section, the second stop section extending from one edge of the second fixing section to the first fixing section, which edge is distal from the connection section.

3. The wire connection terminal structure as claimed in claim 2, wherein the conductive plate is made of a high-conductivity material with an electrical conductivity better than the leaf spring and the fixing frame.

4. The wire connection terminal structure as claimed in claim 2, wherein the soldering leg of the base section extends from at least one end of the base section.

5. The wire connection terminal structure as claimed in claim 2, wherein the conductive plate and the fixing frame are further formed with engagement structures to help in locating the conductive plate and the fixing frame.

6. The wire connection terminal structure as claimed in claim 1, wherein the locating section of the leaf spring is engaged with a boss section of the first fixing section and located thereon.

7. The wire connection terminal structure as claimed in claim 6, wherein the conductive plate is made of a high-conductivity material with an electrical conductivity better than the leaf spring and the fixing frame.

8. The wire connection terminal structure as claimed in claim 6, wherein the soldering leg of the base section extends from at least one end of the base section.

9. The wire connection terminal structure as claimed in claim 6, wherein the conductive plate and the fixing frame are further formed with engagement structures to help in locating the conductive plate and the fixing frame.

10. The wire connection terminal structure as claimed in claim 1, wherein the conductive plate is made of a high-conductivity material with an electrical conductivity better than the leaf spring and the fixing frame.

11. The wire connection terminal structure as claimed in claim 10, wherein the soldering leg of the base section extends from at least one end of the base section.

12. The wire connection terminal structure as claimed in claim 10, wherein the conductive plate and the fixing frame are further formed with engagement structures to help in locating the conductive plate and the fixing frame.

13. The wire connection terminal structure as claimed in claim 1, wherein the leaf spring is made of an elastic material.

14. The wire connection terminal structure as claimed in claim 13, wherein the fixing frame is made of a rigid material.

15. The wire connection terminal structure as claimed in claim 13, wherein the soldering leg of the base section extends from at least one end of the base section.

16. The wire connection terminal structure as claimed in claim 13, wherein the conductive plate and the fixing frame are further formed with engagement structures to help in locating the conductive plate and the fixing frame.

17. The wire connection terminal structure as claimed in claim 1, wherein the fixing frame is made of a rigid material.

18. The wire connection terminal structure as claimed in claim 17, wherein the soldering leg of the base section extends from at least one end of the base section.

19. The wire connection terminal structure as claimed in claim 17, wherein the conductive plate and the fixing frame are further formed with engagement structures to help in locating the conductive plate and the fixing frame.

20. The wire connection terminal structure as claimed in claim 1, wherein the soldering leg of the base section extends from at least one end of the base section.

21. The wire connection terminal structure as claimed in claim 20, wherein the conductive plate and the fixing frame are further formed with engagement structures to help in locating the conductive plate and the fixing frame.

22. The wire connection terminal structure as claimed in claim 1, wherein the conductive plate and the fixing frame are further formed with engagement structures to help in locating the conductive plate and the fixing frame.

23. The wire connection terminal structure as claimed in claim 1, wherein the conductive plate and the fixing frame are further formed with engagement structures to help in locating the conductive plate and the fixing frame.

24. A wire connection terminal structure comprising a leaf spring, a conductive plate and a fixing frame, which are mounted in an insulation case, the leaf spring and the conductive plate being framed and assembled with the fixing frame, the conductive plate being formed with a base section assembled with the fixing frame and at least one soldering leg extending from the base section out of the case, the leaf spring being formed with an elastic swingable holding section extending to a position in contact with the base section, the leaf spring being further formed with a locating section secured to the fixing frame and a bight section connected between the locating section and the holding section, the holding section and the base section defining therebetween an elastic holding mouth, a width of the bight section between two sides thereof being larger than a width of at least one of the holding section and the locating section between two sides thereof.

25. A wire connection terminal structure comprising a leaf spring, a conductive plate and a fixing frame, which are mounted in an insulation case, the fixing frame having a first fixing section, a second fixing section and a connection section in the form of a frame, the second fixing section being positioned in a position opposite to the first fixing section, the connection section being connected between the first and second fixing sections, the leaf spring and the conductive plate being framed and assembled with the fixing frame, the leaf spring and the conductive plate being respectively disposed and located on the first and second fixing sections, the conductive plate being formed with a base section assembled with the fixing frame and at least one soldering leg extending from the base section out of the case, the leaf spring being formed with an elastic swingable holding section extending to a position in contact with the base section, the elastic swingable holding section extending from the leaf spring to the base section of the conductive plate for pushing the base section and fixing the base section on the second fixing section, the leaf spring being further formed with a locating section secured to the fixing frame and a bight section connected between the locating section and the holding section, the holding section and the base section defining therebetween an elastic holding mouth, the connection section being formed with a stop section, the stop section extending from one edge of the connection section between the first and second fixing sections in a position opposite to the holding mouth.

26. The wire connection terminal structure as claimed in claim 25, wherein the conductive plate is made of a high-conductivity material with an electrical conductivity better than the leaf spring and the fixing frame.

27. The wire connection terminal structure as claimed in claim 25, wherein the soldering leg of the base section extends from at least one end of the base section.

28. The wire connection terminal structure as claimed in claim 25, wherein the conductive plate and the fixing frame are further formed with engagement structures to help in locating the conductive plate and the fixing frame.

* * * * *